US006173263B1

(12) United States Patent
Conkie

(10) Patent No.: US 6,173,263 B1
(45) Date of Patent: Jan. 9, 2001

(54) METHOD AND SYSTEM FOR PERFORMING CONCATENATIVE SPEECH SYNTHESIS USING HALF-PHONEMES

(75) Inventor: Alistair Conkie, Morristown, NJ (US)

(73) Assignee: AT&T Corp., New York, NY (US)

( * ) Notice: Under 35 U.S.C. 154(b), the term of this patent shall be extended for 0 days.

(21) Appl. No.: 09/144,020

(22) Filed: Aug. 31, 1998

(51) Int. Cl.[7] ..... G10L 13/08
(52) U.S. Cl. ..... 704/260; 704/268
(58) Field of Search ..... 704/260, 268, 704/258, 255, 254, 262

(56) References Cited

U.S. PATENT DOCUMENTS 3,704,345 * 11/1972 Coker et al. ..... 704/260
5,633,983 * 5/1997 Coker ..... 704/260

OTHER PUBLICATIONS

IEEE International Conference on Acoustics, Speech and Signal Processing. Lee et al., "TTS based very low bit rate speech coder". pp. 181–184 vol. 1, Mar. 1999.*

* cited by examiner

*Primary Examiner*—Richemond Dorvil

(57) ABSTRACT

A method and system are provided for performing concatenative speech synthesis using half-phonemes to allow the full utilization of both diphone synthesis and unit selection techniques in order to provide synthesis quality that can combine intelligibility achieved using diphone synthesis with a naturalness achieved using unit selection. The concatenative speech synthesis system may include a speech synthesizer that may comprise a linguistic processor, a unit selector and a speech processor. A speech training module may input trained speech off-line to the unit selector. The concatenative speech synthesis may normalize the input text in order to distinguish sentence boundaries from abbreviations. The normalized text is then grammatically analyzed to identify the syntactic structure of each constituent phrase. Orthographic characters used in normal text are mapped into appropriate strings of phonetic segments representing units of sound and speech. Prosody is then determined and timing and intonation patterns are then assigned to each of the half-phonemes. Once the text is converted into half-phonemes, the unit selector compares a requested half-phoneme sequence with units stored in the database in order to generate a candidate list for each half-phoneme. The candidate list is then input into a Viterbi searcher which determines the best match of all half-phonemes in the phoneme sequence. The selected string is then output to a speech processor for processing output audio to a speaker.

20 Claims, 9 Drawing Sheets

METHOD AND SYSTEM FOR PERFORMING CONCATENATIVE SPEECH SYNTHESIS USING HALF-PHONEMES

BACKGROUND OF THE INVENTION

1. Field of Invention

The invention relates to a method and apparatus for performing concatenative speech synthesis using half-phonemes. In particular, a technique is provided for combining two methods of speech synthesis to achieve a level of quality that is superior to either technique used in isolation.

2. Description of Related Art

There are two categories of speech synthesis techniques frequently used today, diphone synthesis and unit selection synthesis. In diphone synthesis, a diphone is defined as the second half of one phoneme followed by the initial half of the following phoneme. At the cost of having N×N (capital N being the number of phonemes in a language or dialect) speech recordings, i.e., diphones, in a database, one can achieve high quality synthesis. An appropriate sequence of diphones are concatenated into one continuous signal using a variety of techniques (e.g., time-domain Pitch Synchronis Overlap and Add (TD-PSOLA)). For example, in English, N would equal between 40–45 phonemes depending on regional accent and the phoneme set definition.

This approach does not, however, completely solve the problem of providing smooth concatenation, nor does it solve the problem of providing natural-sounding synthetic speech. There is generally some spectral envelope mismatch at the concatenation boundaries. For severe cases, depending on the treatment of the signals, a signal may exhibit glitches or there may be degradation in the clarity of the speech. Consequently, a great deal of effort is often spent on choosing appropriate diphone units that will not have these defects irrespective of which other units they are matched with. Thus, in general, much effort is devoted to preparing a diphone set and selecting sequences that are suitable for recording and in verifying that the recordings are suitable for the diphone set.

Another approach to concatenative synthesis is to use a very large database for recorded speech that has been segmented and labeled with prosodic and spectral characteristics, such as the fundamental frequency (F0) for voiced speech, the energy or gain of the signal, and the spectral distribution of the signal (i.e., how much of the signal is present at any given frequency). The database contains multiple instances of speech sounds. This permits the possibility of having units in the database which are much less stylized than would occur in a diphone database where generally only one instance of any given diphone is assumed. Therefore, the possibility of achieving natural speech is enhanced.

For good quality synthesis, this technique relies on being able to select units from the database, currently only phonemes or a string of phonemes, that are close in character to the prosodic specification provided by the speech synthesis system, and that have a low spectral mismatch at the concatenation points. The "best" sequence of units is determined by associating a numerical cost in two different ways. First, a cost (target cost) is associated with the individual units (in isolation) so that a lower cost results if the unit has approximately the desired characteristics, and a higher cost results if the unit does not resemble the required unit. A second cost (concatenation cost) is associated with how smoothly units are joined together. Consequently, if the spectral mismatch is bad, there is a high cost associated, and if the spectral mismatch is low, a low cost is associated.

Thus, a set of candidate units for each position in the desired sequences (with associated costs), and a set of costs associated with joining any one to its neighbors, results. This constitutes a network of nodes (with target costs) and links (with concatenation costs). Estimating the best (lowest-cost) path through the network is done using a technique called Viterbi search. The chosen units are then concatenated to form one continuous signal using a variety of techniques.

This technique permits synthesis that sounds very natural at times but more often sounds very bad. In fact, intelligibility can be lower than for diphone synthesis. For the technique to adequately work, it is necessary to do extensive searching for suitable concatenation points even after the individual units have been selected. This is because phoneme boundaries are frequently not the best place to try to concatenate two segments of speech.

SUMMARY OF THE INVENTION

A method and system are provided for performing concatenative speech synthesis using half-phonemes to allow the full utilization of both diphone synthesis and unit selection techniques in order to provide synthesis quality that can combine intelligibility achieved using diphone synthesis with a naturalness achieved using unit selection. The concatenative speech synthesis system may include a speech synthesizer that may comprise a linguistic processor unit, a unit selector and a speech processor. A speech training module may be used offline to match synthesis specification with appropriate units for the unit selector.

The concatenative speech synthesis may normalize the input text in order to distinguish sentence boundaries from abbreviations. The normalized text is then grammatically analyzed to identify the syntactic structure of each constituent phrase. Orthographic characters used in normal text are mapped into appropriate strings of phonetic segments representing units of sound and speech. Prosody is then determined and timing and intonation patterns are then assigned to each of the phonemes. The phonemes are then divided into half-phonemes.

Once the text is converted into half-phonemes, the unit selector compares a requested half-phoneme sequence with units stored in the database in order to generate a candidate list of units for each half-phoneme using the correlations from the training phase. The candidate list is then input into a Viterbi searcher which determines the best overall sequence of half-phoneme units to process for synthesis. The selected string of units is then output to a speech processor for processing output audio to a speaker.

BRIEF DESCRIPTION OF THE DRAWINGS

The invention is described in detail with reference to the following drawings, wherein like numerals represent like elements, and wherein.

DETAILED DESCRIPTION OF PREFERRED EMBODIMENTS

Figure 1:
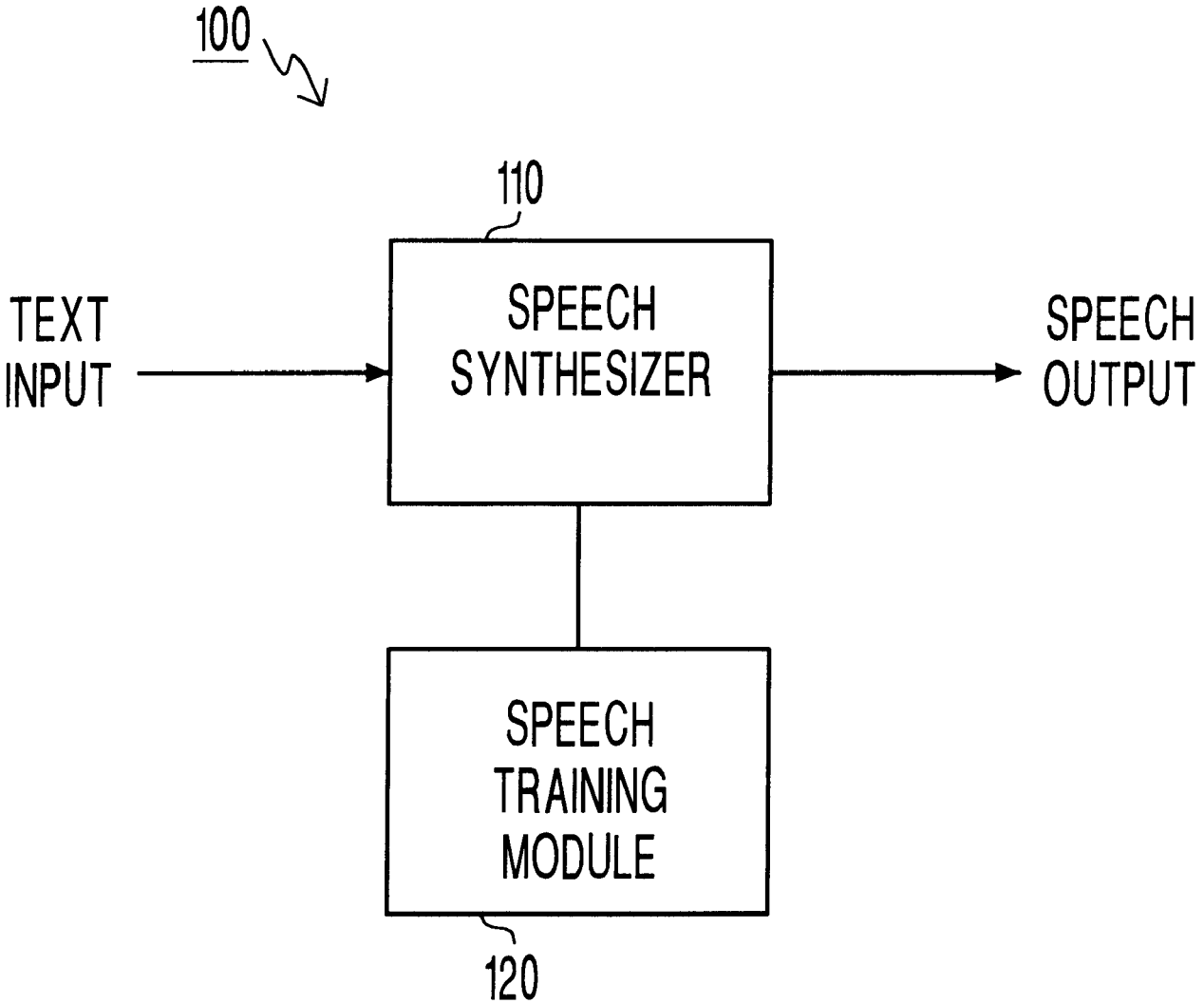
FIG. 1 is a block diagram of an exemplary speech synthesis system.

FIG. 1 shows an exemplary diagram of a speech synthesis system 100 that includes a speech synthesizer 110 connected to a speech training module 120. The speech training module 120 establishes a metric for selection of appropriate units from the database. This information is input off-line prior to any text input to the speech synthesizer 110. The speech synthesizer 110 represents any speech synthesizer known to one of skilled in the art which can perform the functions of the invention disclosed herein or the equivalence thereof.

In its simplest form, the speech synthesizer 110 takes text input from a user in several forms, including keyboard entry, scanned in text, or audio, such as a foreign language which has been processed through a translation module, etc. The speech synthesizer 110 then converts the input text to a speech output using the disclosed method for concatenative speech synthesis using half-phonemes, as set forth in detail below.

Figure 2:
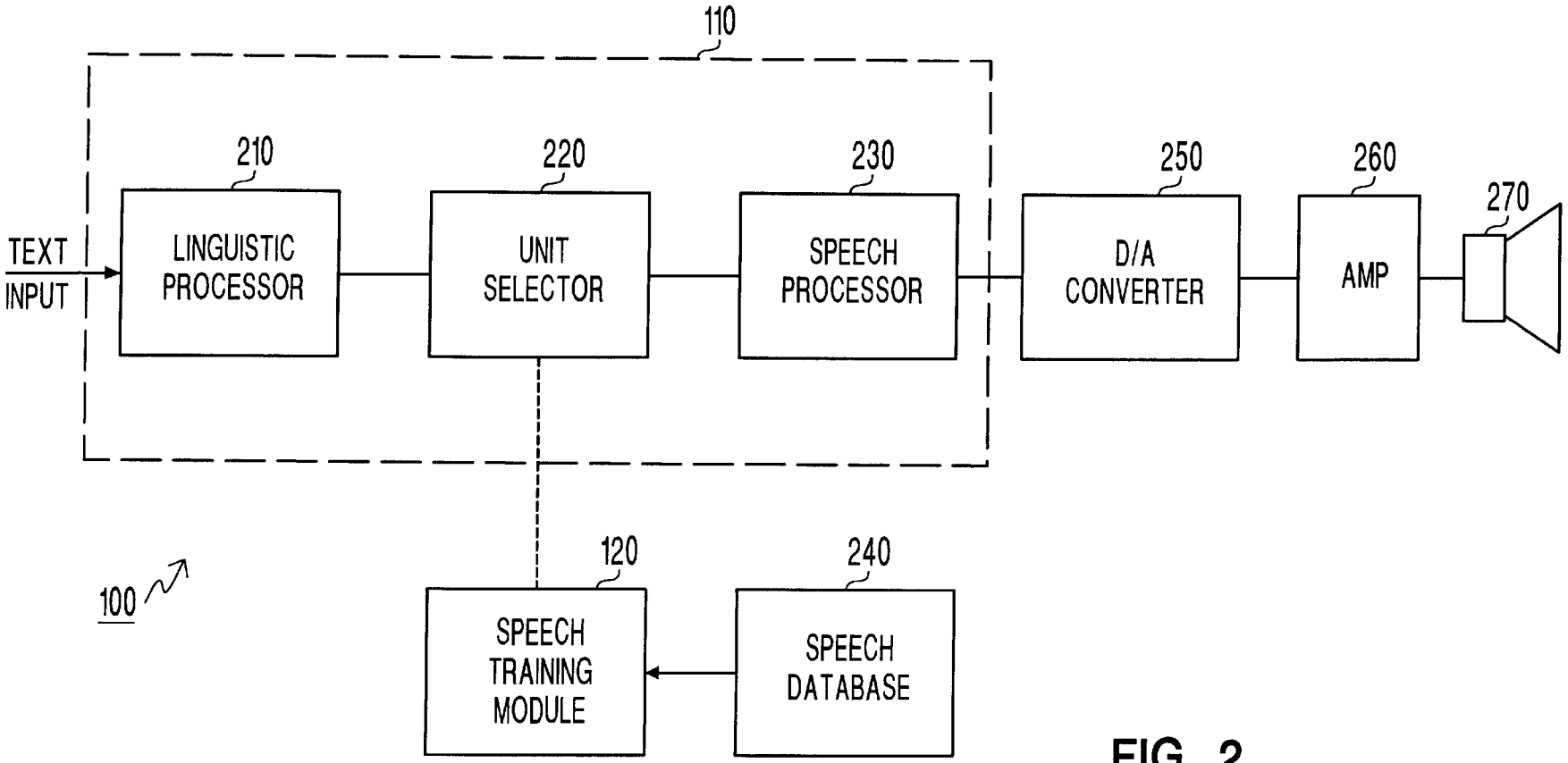
FIG. 2 is a more detailed block diagram of FIG. 1.

FIG. 2 shows a more detailed exemplary block diagram of the synthesis system 100 of FIG. 1. The speech synthesizer 110 consists of the linguistic processor 210, unit selector 220 and speech processor 230. The speech synthesizer 110 is also connected to the speaker 270 through the digital/analog (D/A) converter 250 and amplifier 260 in order to produce an audible speech output. Prior to the speech synthesis process, the speech synthesizer 110 receives mapping information from the training module 120. The training module 120 is connected to a speech database 240. This speech database 240 may be any memory device internal or external to the training module 120. The speech database 240 contains an index which lists phonemes in ASCII, for example, along with their associated start times and end times as reference information, and derived linguistic information, such as phones, voicing, etc. The speech database 240 itself consists of raw speech in digital format.

Text is input to the linguistic processor 210 where the input text is normalized, syntactically parsed, mapped into an appropriate string of phonetic segments or phonemes, and assigned a duration and intonation pattern. A half-phoneme string is then sent to unit selector 220. The unit selector 220 selects candidates for requested half-phoneme sequence with half-phonemes based on correlations established in the training module 120 from speech database 240. The unit selector 220 then applies a Viterbi mechanism to the selected or candidate list of phonemes. The Viterbi mechanism outputs the "best" candidate sequence to the speech processor 230. The speech processor 230 processes the candidate sequence into synthesized speech and outputs the speech to the amplifier 260 through the D/A converter 250. The amplifier 260 amplifies the speech signal and produces an audible speech output through speaker 270.

In describing how the speech training module 120 operates, consider a large database of speech labelled as phonemes (to avoid repeating one-half everywhere). Now for simplicity only consider a small subject of three "sentences" or speech files.

| | |
|---|---|
| /s//$ae_1$//t/ | [sat] |
| /k//$ae_3$//r/ | [car] |
| /m//$ae_2$//p/ | [map] |

Training does the following:

1. Compute costs in terms of acoustic parameters between all units of same type. (Illustrated with /ae/.) A matrix something like the one below results (with the numbers chosen for illustration only and calculated normally using MEL Cepstral distance measurements):

| | /$ae_1$/ | /$ae_2$/ | /$ae_3$/ |
|---|---|---|---|
| /$ae_1$/ | 0 | 0.3 | 1.7 |
| /$ae_2$/ | 0.3 | 0 | 2.1 |
| /$ae_3$/ | 1.7 | 2.1 | 0 |

This example shows that /$ae_1$/ and /$ae_2$/ are quite alike but /$ae_3$/ is different.

2. Based on this knowledge (costs in matrix) the important information about the data that gives low costs may be statistically examined. For example, vowel duration may be important because if vowel lengths are similar, costs may be lower. However, it may be that context is important. In the example given above, /$ae_3$/ is different from the other two. Often a following /r/ phoneme will lead to a modification of a vowel.

Therefore, in the training phase, access to spectral information (since we train the database on itself) allows the calculation of costs. This allows us to analyze, in terms of parameters we do have access to at synthesis time (since we are synthesizing we have no spectral information only a specification), how costs are related to durations, F0, context, etc. Thus, training produces a mapping, or a correlation, that can used when performing unit selection synthesis.

Figure 3:
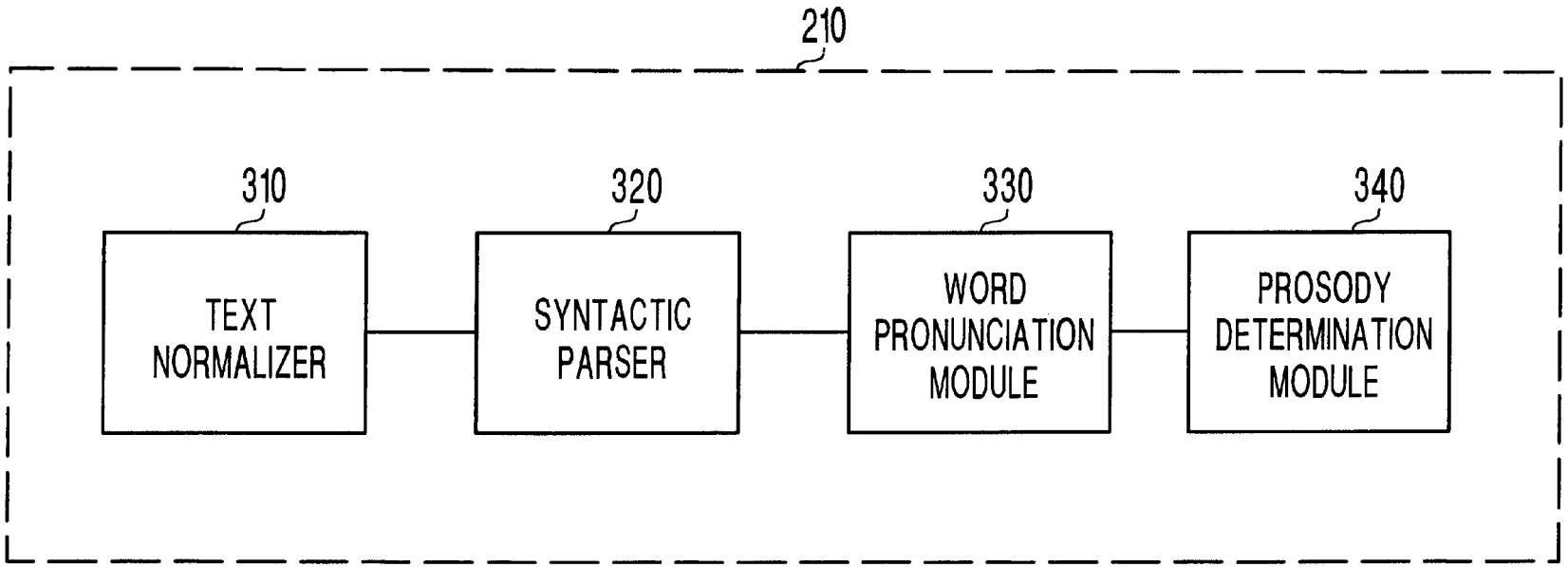
FIG. 3 is a block diagram of the linguistic processor.

FIG. 3 is a more detailed diagram of the linguistic processor 210. Text is input to the text normalizer 310 via a keyboard, etc. The input text must be normalized in order to distinguish sentence boundaries from abbreviations, to expand conventional abbreviations, and to translate non-alphabetic characters into a pronounceable form. For example, if "St." is input, the speech synthesizer 110 must know that it should not process the abbreviation for the "St" sound. The speech synthesizer 110 must realize that the "St." abbreviation should be pronounced as "saint" or "street". Furthermore, money figures, such as $1234.56 should be recognized and be pronounced as "one thousand two hundred thirty four dollars and fifty six cents", for example.

Once the text has been normalized, the text is input to the syntactic parser 320. The syntactic parser 320 performs grammatical analysis of a sentence to identify the syntactic structure of each constituent phrase and word. For example, the syntactic parser 320 will identify a particular phrase as a "noun phrase" or a "verb phrase" and a word as a noun, verb, adjective, etc. Syntactic parsing is important because whether the word or phrase is being used as a noun or a verb may affect how it is articulated. For example, in the sentence "the cat ran away", if "cat" is identified as a noun and "ran" is identified as a verb, the speech synthesizer 110 may assign the word "cat" a different sound duration or intonation pattern than "ran" because of its position and function in the sentence structure.

Once the syntactic structure of the text has been determined, the text is input to the word pronunciation module 330. In the word pronunciation module 330, orthographic characters used in the normal text are mapped into the appropriate strings of phonetic segments representing units of sound and speech. This is important because the same orthographic strings may have different pronunciations depending on the word in which the string is used. For example, the orthographic string "gh" is translated to the phoneme /f/ in "tough", to the phoneme /g/ in "ghost", and is not directly realized as any phoneme in "though". Lexical stress is also marked. For example, "record" has a primary stress on the first syllable if it is a noun, but has the primary stress on the second syllable if it is a verb.

The strings of phonetic segments are then input into the prosody determination module 340. The prosody determination module 340 assigns patterns of timing and intonation to the phonetic segment strings. The timing pattern includes the duration of sound for each of the phonemes. For example, the "re" in the verb "record" has a longer duration of sound than the "re" in the noun "record". Furthermore, the intonation pattern concerns pitch changes during the course of an utterance. These pitch changes express accentuation of certain words or syllables as they are positioned in a sentence and help convey the meaning of the sentence. Thus, the patterns of timing and intonation are important for the intelligibility and naturalness of synthesized speech.

Figure 4:
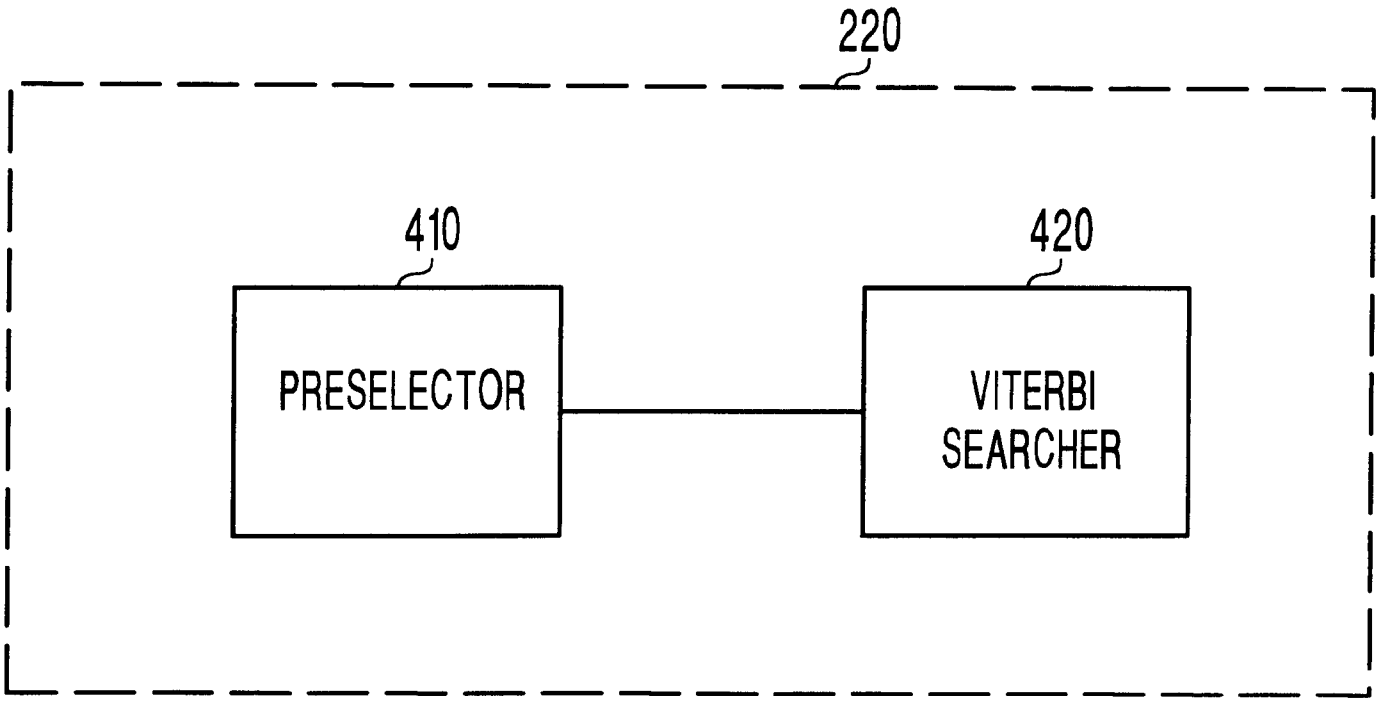
FIG. 4 is a block diagram of the unit selector of FIG. 1.

After the phoneme sequence has been processed by the prosody determination module 340 of the linguistic processor 210, a half-phoneme sequence is input to the unit selector 220. The unit selector 220, as shown in FIG. 4, consists of a preselector 410 and a Viterbi searcher 420. Unit selection, in general, refers to a speech synthesis method by concatenation of sub-word units, such as phonemes, half-phonemes, diphones, triphones, etc. Phonemes, for example, are the smallest meaningful contrastive unit in a language, such as the "k" sound in cat. A half-phoneme is half of a phoneme. The phoneme boundary is the normal one. The phoneme-internal boundary can be the mid-point, or based on minimization of some parameter, or based on spectral characteristics of the phoneme. A diphone is a unit that extends from the middle of one phoneme in a sequence to the middle of the next phoneme in a sequence. A triphone is like a longer diphone, or a diphone with a complete phoneme in the middle. A syllable is basically a segment of speech which contains a vowel and may be surrounded by consonants or occur alone. Consonants which belong between two vowels get associated with the vowel that sounds most natural when speaking the word slowly.

Concatenative synthesis can produce reliable clear speech and is the basis for a number of commercial systems. However, when simple diphones are processed, unit selection does not provide the naturalness of real speech. In attempting to provide naturalness, a variety of techniques may be used, including changing the size of the units, and recording a number of occurrences of each unit.

There are several methods of performing concatenative synthesis. The choice depends on the intended task for which the units are used. The most simplistic method is to record the voice of a person speaking the desired phrases. This is useful if only a limited number of phrases and sentences is used. For example, messages in a train station or airport, scheduling information, speaking clocks, etc., are limited in their content and vocabulary such that a recorded voice may be used. The quality depends on the way the recording is done.

A more general method is to split the speech into smaller pieces. While the smaller pieces are less in number, the quality of sound suffers. In this method, the phoneme is the most basic unit one can use. Depending on the language, there are about 35–50 phonemes in Western European languages (i.e., there are about 35–50 single recordings). While this number is relatively small, the problem occurs in combining them as fluent speech because this requires fluent transitions between the elements. Thus, while the required memory space is small, the intelligibility of speech is lower.

A solution to this dilemma is the use of diphones. Instead of splitting the speech at the phoneme transitions, the cut is done at the center of the phonemes. This leaves the transitions themselves intact. However, this method needs about N×N or 1225–2500 elements. The large number of elements increases the quality of speech. Other units may be used instead of diphones, however, including half-syllables, syllables, words, or combinations thereof, such as word stems and inflectional endings.

If we use half-phonemes, then we have approximately 2N or 70–100 basic units. Thus, unit selection can be performed from a large database using half-phonemes instead of phonemes, without substantially changing the algorithm. In addition, there is a larger choice of concatenation points (twice as many). For example, choices could be made to concatenate only diphone boundaries using diphone synthesis (but with a choice of diphones since there are generally multiple instances in the database), or to concatenate only at phoneme boundaries. So the choice of half-phonemes allows us to combine the features of two different synthesis systems, and to do things that neither system can do individually. In the general case, concatenation can be performed at phoneme boundaries or at mid-phoneme as determined by the Viterbi search, so as to produce synthesis quality higher than for the two special examples mentioned above.

Figure 5:
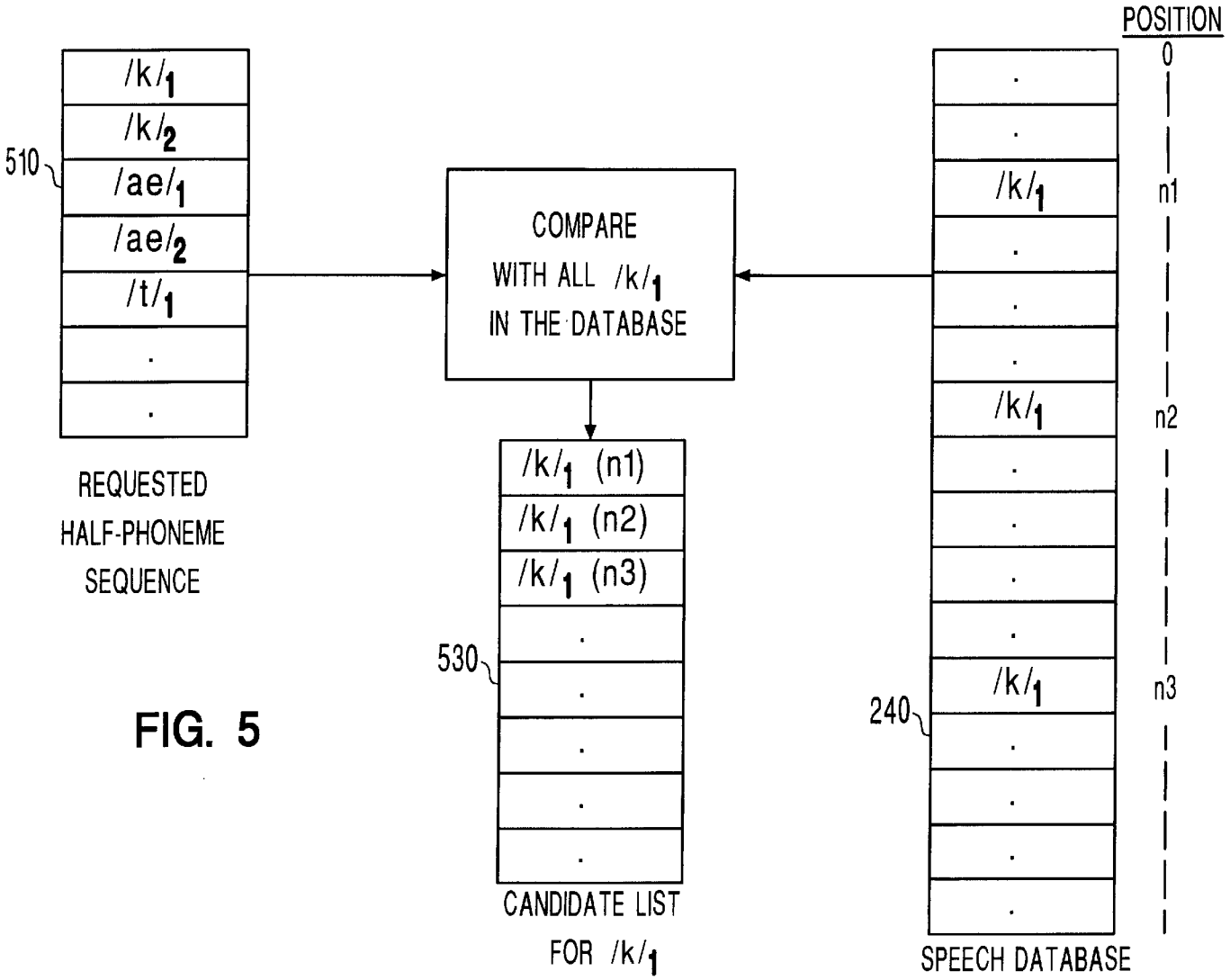
FIG. 5 is a diagram illustrating the pre-selection process.

As shown in FIG. 4, the phoneme sequence is input to the preselector 410 of the unit selector 220. The operation of the preselector 410 is illustrated in FIG. 5. In FIG. 5, the requested phoneme/half-phoneme sequence 510 contains individual phonemes /k/, /ae/, /t/ for the word "cat". Each request phoneme, for example, the $/k/_1$, is compared with all possible $/k/_1$ phonemes in the database 240. All possible $/k/_1$ phonemes are collected and input into a candidate list 530. The candidate list 530 may include, for example, all $/k/_1$ phonemes or only those $/k/_1$ phonemes that are equivalent to or below a predetermined cost threshold.

The candidate list is then input into a Viterbi searcher 420. The Viterbi search process is illustrated in FIGS. 6 and 7.

Figure 6:
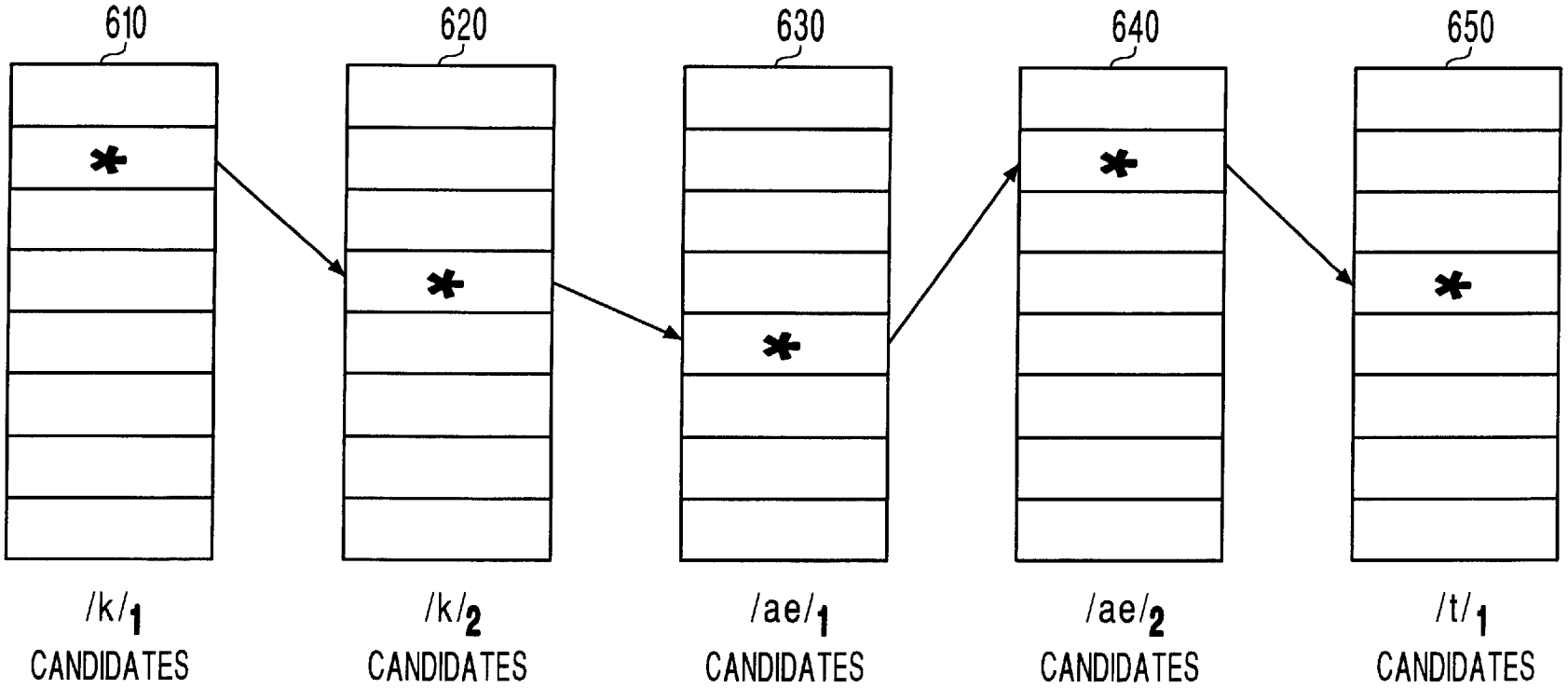
FIG. 6 is a diagram illustrating the Viterbi search process.

As shown in FIG. 6, the Viterbi search finds the "best" phoneme sequence path between the phonemes in the requested phoneme sequence. Phonemes from candidates 610–650 are linked according to the cost associated with each candidate and the cost of connecting two candidates from adjacent columns. The cost represents a suitability measurement whereby the lowest number represents the best cost. Therefore, the best or selected path is the one with the lowest cost.

Figure 7:
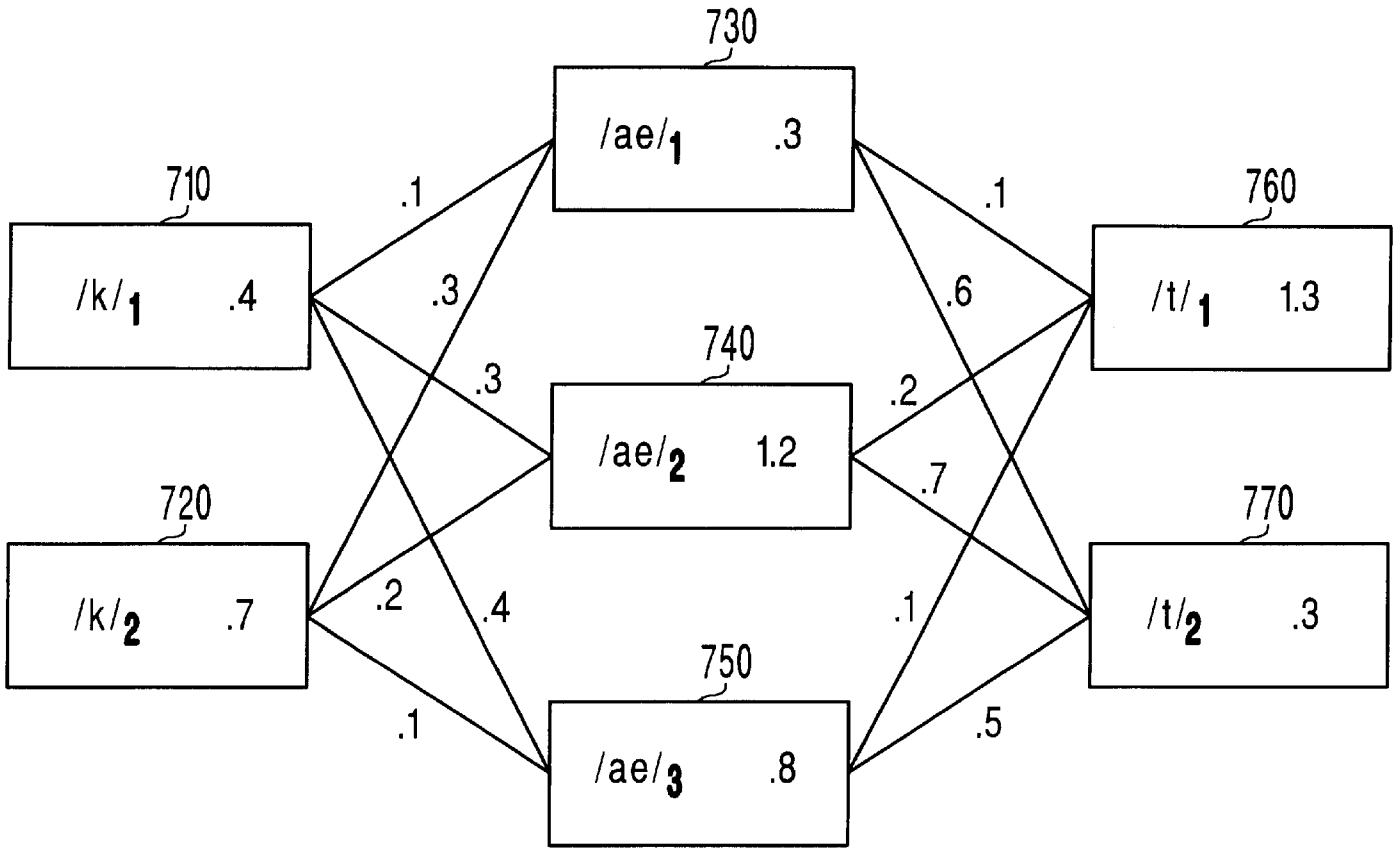
FIG. 7 is a more detailed diagram of FIG. 6.

FIG. 7 illustrates a particularly simple example using the word "cat", represented as /k/ /ae/ /t/, as phonemes. For ease of discussion, we use phonemes instead of half-phonemes and assume a small database that produces only two examples of /k/, 3 of /ae/ and 2 of /t/. The associated costs are also arbitrarily selected for discussion purposes.

To find the total cost for any path, the costs are added between the columns. For example, the best cost is $/k/_1+/ae/_1+/t/_2$, which equals the sum of the cost of the individual units, or 0.4+0.3+0.3=1.0, plus the cost of connecting the candidates, or 0.1+0.6=0.7, for a total of 1.7. Thus, this phoneme sequence is the one that will get synthesized.

Figure 8:
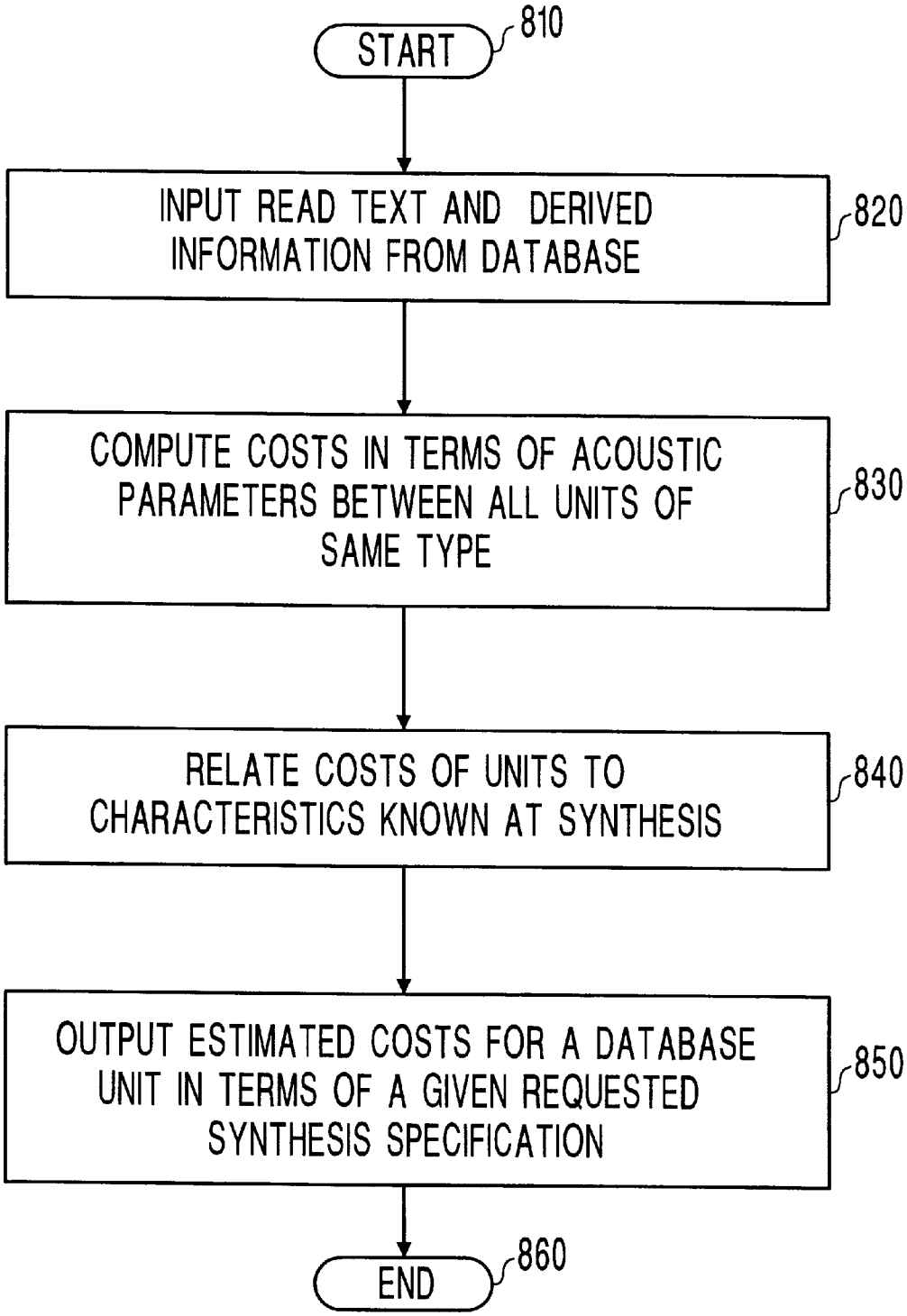
FIG. 8 is a flowchart of the speech database training process.

FIG. 8 is a flowchart of the training process performed by the speech training module 120. Beginning at step 810, control goes to step 820 where read text and derived information is input to the speech training module 120 from the speech database 240. From the database input, at step 830, the training module 120 computes distances or costs in terms of acoustic parameters between all units of the same type. At step 840, the training module 120 relates costs of the units to characteristics known at the time synthesis is conducted.

Then, at step 850, the training module 120 outputs estimated costs for a database unit in terms of a given requested synthesis specification to the preselector 410 of the unit selector 220. The process then goes to step 860 and ends.

Figure 9:
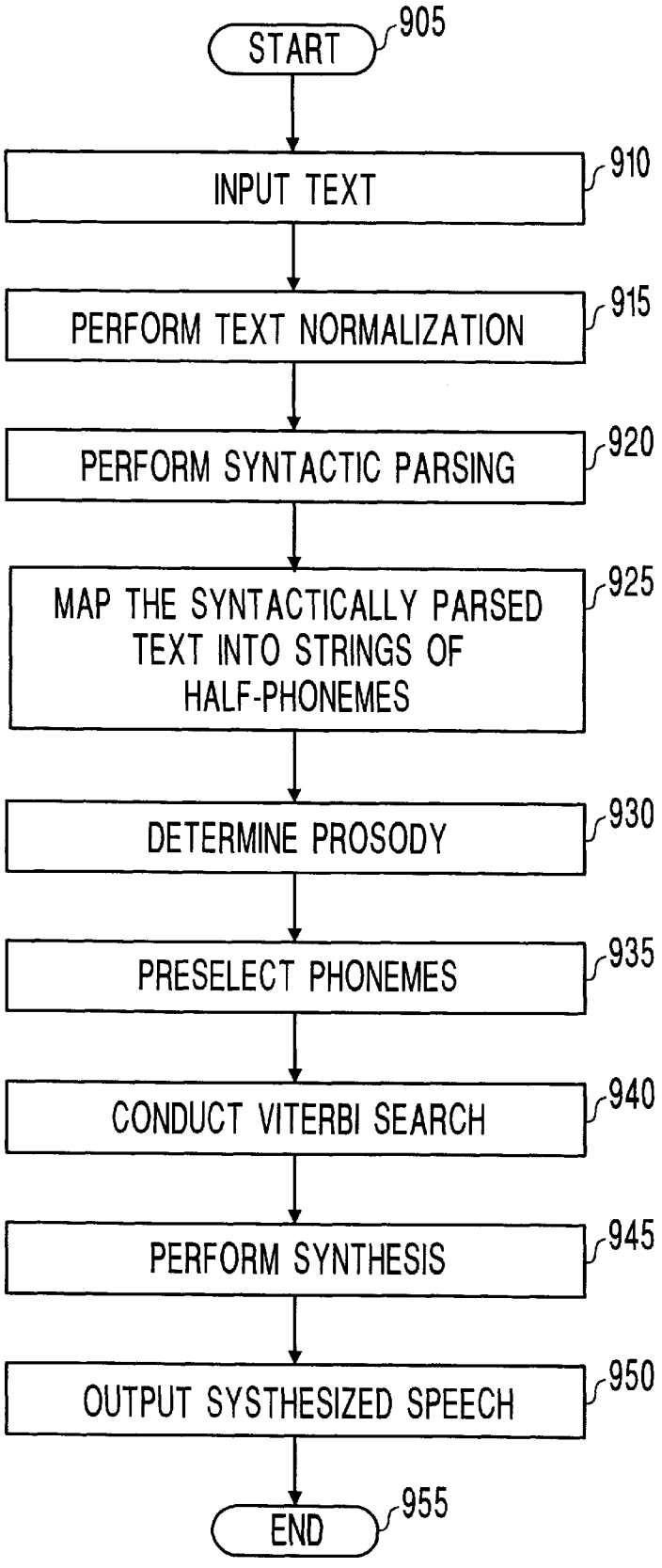
FIG. 9 is a flowchart of the speech synthesis process.

FIG. 9 is a flowchart of the speech synthesis system process. Beginning at step 905, the process goes to step 910 where text is input from, for example, a keyboard, etc., to the text normalizer 310 of the linguistic processor 210. At step 915, the text is normalized by the text normalizer 310 to identify, for example, abbreviations. At step 920, the normalized text is syntactically parsed by the syntactic parser 320 so that the syntactic structure of each constituent phrase or word is identified as, for example, a noun, verb, adjective, etc. At step 925, the syntactically parsed text is mapped into appropriate strings of half-phonemes by the word pronunciation module 330. Then, at step 930, the mapped text is assigned patterns of timing and intonation by the prosody determination module 340.

At step 935, the half-phoneme sequence is input to the preselector 410 of unit selector 220 where a candidate list of each of the requested half-phoneme sequence elements are generated and compared with half-phonemes stored in database 240. At step 940, a Viterbi search is conducted by the Viterbi searcher 420 to generate a desired sequence of half-phonemes based on the lowest cost computed from the cost within each candidate list of the half-phonemes and the cost of the connection between half-phoneme candidates. Then at step 945, synthesis is performed on the half-phoneme sequence with the lowest cost by the speech processor 230.

The speech processor 230 performs concatenated synthesis that uses an inventory of phonetically labeled naturally recorded speech as building blocks from which any arbitrary utterance can be constructed. The size of the minimal unit labelled for concatenated synthesis varies from phoneme to syllable (or in this case a half-phoneme), depending upon the synthesizing system used. Concatenated synthesis methods use a variety of speech representations, including Linear Predictive Coding (LPC), Time-Domain Pitch-Synchronous Overlap Add (TD-PSOLA) and Harmonic Plus Noise (HNM) models. Basically, any speech synthesizer in which phonetic symbols are transformed into an acoustic signal that results in an audible message may be used.

At step 950, the synthesized speech is sent to amplifier 260 which amplifies the speech so that it may be audibly output by speaker 270. The process then goes to step 955 and ends.

The speech synthesis system 100 may be implemented on a general purpose computer. However, the speech synthesis system 100 may also be implemented using a special purpose computer, a microprocessor or microcontroller in peripheral integrated circuit elements, and Application Specific Integrated Circuit (ASIC) or other integrated circuits, a hard wired electronic or logic circuit, such as a discrete element circuit, a programmable logic device, such as a PLD, PLA, FGPA, or PAL, or the like. Furthermore, the functions of the speech synthesis system 100 may be performed by a standalone unit or distributed through a speech processing system. In general, any device performing the functions of the speech synthesis system 100, as described herein, may be used.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. Various changes may be made without departing from the spirit and scope of the invention as described in the following claims.

What is claimed is:

1. A method of synthesizing speech using half-phonemes, comprising:

receiving input text;

converting the input text into a sequence of half-phonemes;

comparing the half-phonemes in the sequence with a plurality of half-phonemes stored in a database;

selecting one of the plurality of half-phonemes from the database for each of the half-phonemes in the sequence based on statistical measurements;

processing the selected half-phonemes into synthesized speech; and outputting the synthesized speech to an output device.

2. The method of claim 1, wherein the converting step comprises the steps of:

normalizing the input text to distinguish sentence boundaries from abbreviations;

grammatically analyzing the input text to syntactically identify parts-of-speech;

mapping the input text into phonetic segments of speech and sound; and assigning timing and intonation patterns to each of the phonetic segments.

3. The method of claim 1, wherein the comparing step produces a pre-selected candidate list of half-phonemes from the database.

4. The method of claim 3, wherein the comparing step pre-selects candidate half-phonemes based on a predetermined threshold.

5. The method of claim 3, wherein the selecting step selects half-phonemes from the candidate half-phonemes using a Viterbi search mechanism.

6. The method of claim 1, wherein the selecting step selects half-phonemes based on the statistical measurements computed for individual half-phonemes and spectral measurements computed based on the relationship between half-phonemes in the sequence of half-phonemes.

7. The method of claim 1, further comprising:

computing statistical measurements between half-phonemes of training speech contained in a database; and outputting the statistical measurements for performing the selecting step.

8. The method of claim 6, further comprising:

indexing the half-phonemes in the database based on timing measurements.

9. The method of claim 1, wherein the processing step synthesizes speech using one of Linear Predictive Coding, Time-Domain Pitch-Synchronous Overlap Add, or Harmonic Plus Noise methods.

10. A system for synthesizing speech using half-phonemes, comprising:

a linguistic processor that receives input text and converts the input text into a sequence of half-phonemes;

a unit selector, coupled to the linguistic processor, that compares the half-phonemes in the sequence with a plurality of half-phonemes stored in a database and selects one of the plurality of half-phonemes from the database for each of the half-phonemes in the sequence based on statistical measurements; and a speech processor, coupled to the unit selector, that processes the selected half-phonemes into synthesized speech and outputs the synthesized speech to an output device.

11. The system of claim 10, wherein the linguistic processor further comprises:

a text normalizer that receives and normalizes the input text to distinguish sentence boundaries from abbreviations;

a syntactic parser, coupled to the text normalizer, that grammatically analyzes the input text to syntactically identify parts-of-speech;

a word pronunciation module, coupled to the syntactic parser, that maps the input text into phonetic segments of speech and sound; and a prosodic determination module, coupled to the word pronunciation module, that assigns timing and intonation patterns to each of the phonetic segments.

12. The system of claim 10, wherein the unit selector further comprises:

a preselector that selects a candidate list of half-phonemes from the database.

13. The system of claim 12, wherein the preselector selects candidate half-phonemes based on a predetermined threshold.

14. The system of claim 13, wherein the unit selector further comprises:

a Viterbi searcher, coupled to the preselector, that selects half-phonemes from the candidate half-phonemes using Viterbi search mechanisms.

15. The system of claim 14, wherein the Viterbi searcher selects half-phonemes based on the statistical measurements computed for individual half-phonemes and spectral measurements computed based on the relationship between half-phonemes in the sequence of half-phonemes.

16. The system of claim 10, further comprising:

a speech training module, coupled to the unit selector, that computes statistical measurements between half-phonemes of training speech contained in a database, and outputs the statistical measurements to the unit selector.

17. The system of claim 16, wherein the speech training module indexes the half-phonemes in the database based on timing measurements.

18. The system of claim 10, wherein the speech processor synthesizes speech using one of Linear Predictive Coding, Time-Domain Pitch-Synchronous Overlap Add, or Harmonic Plus Noise methods.

19. A system for synthesizing speech using half-phonemes, comprising:

linguistic processing means for receiving input text and converting the input text into a sequence of half-phonemes;

unit selecting means for comparing the half-phonemes in the sequence with a plurality of half-phonemes stored in a database and selecting one of the plurality of half-phonemes from the database for each of the half-phonemes in the sequence based on statistical measurements; and speech processing means for processing the selected half-phonemes into synthesized speech and outputting the synthesized speech to an output device.

20. The system of claim 19, further comprising:

text normalizing means for normalizing the input text to distinguish sentence boundaries from abbreviations;

syntactic parsing means for grammatically analyzing the input text to syntactically identify parts-of-speech;

word pronunciation means for mapping the input text into phonetic segments of speech and sound;

prosodic determination means for assigning timing and intonation patterns to each of the phonetic segments;

preselection means for selecting a candidate list of half-phonemes from the database; and Viterbi search means for selecting half-phonemes from the candidate list using Viterbi search mechanisms.

* * * * *